United States Patent [19]

Holmberg et al.

[11] Patent Number: 4,694,995

[45] Date of Patent: Sep. 22, 1987

[54] DEVICE IN CONNECTION WITH CHOPPERS

[75] Inventors: Erne L. Holmberg, Hudiksvall; Torbjorn C. Andersson, Forsa, both of Sweden

[73] Assignee: Aktiebolaget Iggesunds Bruk, Iggesund, Sweden

[21] Appl. No.: 937,434

[22] Filed: Dec. 3, 1986

Related U.S. Application Data

[63] Continuation of Ser. No. 717,584, Mar. 29, 1985, abandoned.

[30] Foreign Application Priority Data

Apr. 21, 1982 [SE] Sweden ..... 8202509

[51] Int. Cl.[4] ..... B02C 18/18

[52] U.S. Cl. ..... 241/92; 241/298

[58] Field of Search ..... 241/92, 298

[56] References Cited

U.S. PATENT DOCUMENTS

| | | | |
|---|---|---|---|
| 3,542,302 | 11/1970 | Salzmann, Jr. | 241/92 X |
| 3,572,594 | 3/1971 | Kershaw | 241/92 X |
| 3,981,337 | 9/1976 | Sundström | 241/92 X |
| 4,155,384 | 5/1979 | Suensson | 241/92 X |
| 4,271,882 | 6/1981 | Valo | 241/92 X |
| 4,298,044 | 11/1981 | Hansel et al. | 241/92 X |
| 4,335,650 | 6/1982 | Prevot | 241/92 X |
| 4,423,758 | 1/1984 | Haller et al. | 241/92 X |

*Primary Examiner*—Howard N. Goldberg
*Assistant Examiner*—Joseph M. Gorski
*Attorney, Agent, or Firm*—Curtis, Morris & Safford

[57] ABSTRACT

A device for use in choppers with a rotating chopper disk (10, 10*a*) having one or more knives attached to knife holders disposed radially on the chopper disk, which knife holders consist of a filler piece (18, 18*a*) fitting into a recess (14, 14*a*) in the chopper disk (10, 10*a*). The filler piece incorporates a mounting either for a knife (30*a*) shaped to fit the mounting, or for a knife holder cassette (26, 28) for the knife (30). The knife (30*a*) or the cassette (26, 28) are attached by means of fasteners (32, 48), such as screws or bolts, inserted from the top side of the chopper disk.

9 Claims, 2 Drawing Figures

DEVICE IN CONNECTION WITH CHOPPERS

This application is a continuation of application Ser. No. 717,584, filed Mar. 29, 1985 now abandoned.

The present invention is concerned with a device for use in connection with choppers having a rotating chopper disk with one or more knives mounted on knife holders disposed radially on the chopper disk.

A problem experienced with choppers of this kind has been that of ensuring the firm attachment of the knives so as to withstand the severe stresses to which the knives and their attachments are subjected during operation. Frequent retensioning and adjustment of the knives were formerly necessary.

Swedish Pat. No. 7314475-0 discloses a device for use in connection with such choppers, equipped with radial through openings in the chopper disk for the flow of chips and with, preferably, reversible knives arranged along said openings, to ensure the firm attachment of said knives with good heat conductivity. The knife is clamped between a subjacent part of the chopper disk, which also acts as a chip-guide for the chips passing through the opening, and a superjacent knife holder, which forms a part of the grinding surface between the radially disposed knives on the upper side of the disk. The device provides a very firm attachment of the knife and high thermal conductivity from the knife to the attachment components. Fastening is by means of a bolt passing from the knife holder through an opening in the chip guide and the chopper disk to the underside of the chopper disk, where it is secured by a nut. To reverse or change the knife it is necessary to undo the nut on the underside of the disk and lift up the relative large, heavy knife holder.

The main object of the present invention is, while retaining the firm attachment of the knife previously disclosed, to simplify the knife clamping device so as to facilitate the changing or reversing of the knife. This object is achieved by endowing the device of the invention with the characteristics set forth in the claims hereafter.

The invention will now be more particularly described with reference to embodiments illustrated in the drawings.

Figure 1:
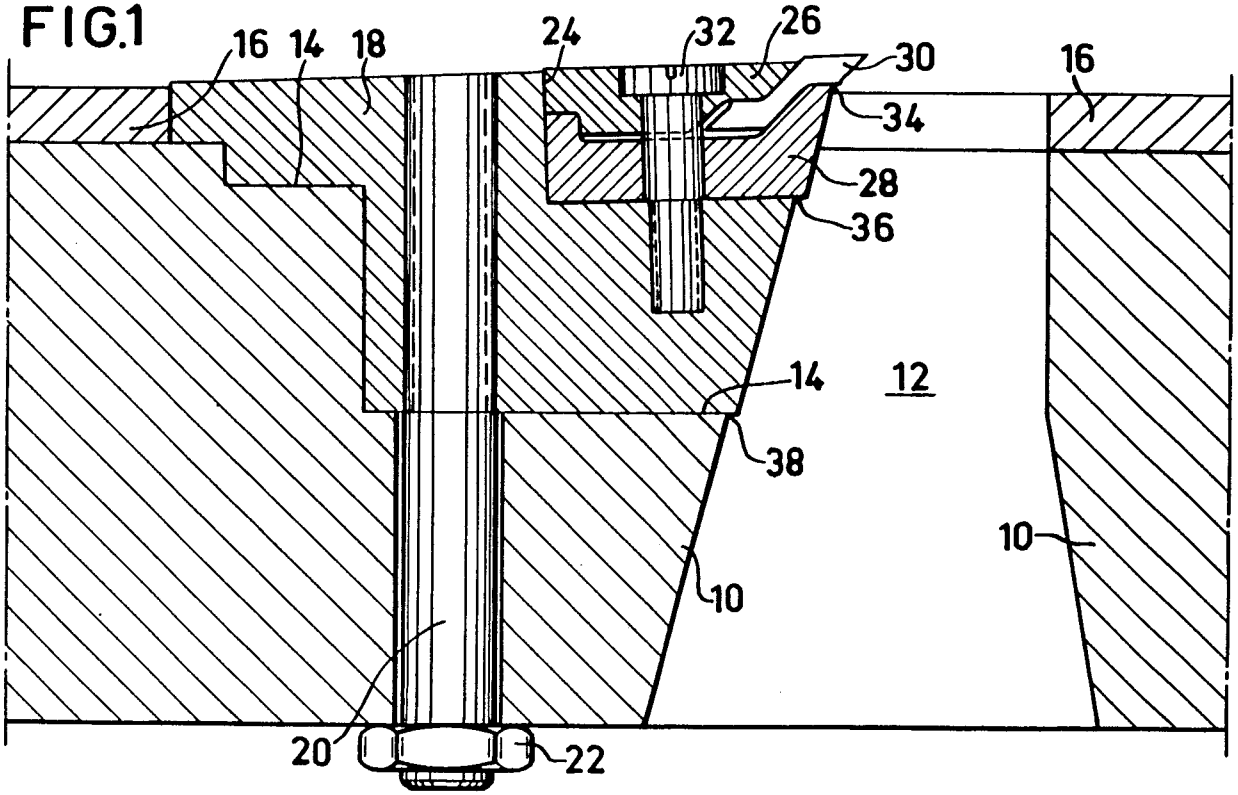
FIG. 1 shows a longitudinal section through part of a chopping disk, equipped with a knife device in accordance with the invention.

FIG. 1 shows a chopping disk 10 with an opening 12 for the chip flow. The chopper disk 10 is equipped at one of the edges adjoining the opening 12—the left edge in FIG. 1—with a rebated recess 14 designed to accommodate a chip guide and a knife holder in the manner disclosed, for example, in the aforementioned Swedish Pat. No. 7314475-0 (U.S. Pat. No. 4,047,670). To the rear of the rebate is a butting wear plate 16 fixed on the surface of the chopper disk in a manner likewise disclosed in the aforementioned patent. A plurality of such openings 12, recesses 14 and associated wear plates 16 are arranged at regular intervals about the circumference of the chopper disk 10.

In the recess 14 there is inserted a filler piece 18 which is retained therein by means of a bolt 20, which is screwed into the filler piece 18 and tightened by means of a nut 22 on the underside of the chopper disk. Thus this filler piece largely replaces the former chip guide and knife holder and is shaped to fit pre-existing recesses 14 in the chopper disk 10. The filler piece is provided at the upper part thereof, facing the opening 12, with a recess 24. In this recess there is inserted a minicassette consisting of a top part 26 and a bottom part 28, which parts 26, 28 are shaped so as to accommodate between them a knife, preferably a reversible knife 30 of the type disclosed in the aforesaid patent. In its assembled condition, with the top part 26 and the bottom part 28 accommodating the knife 30 between them, the said cassette fits into the recess 24 in the filler piece 18. The cassette is provided for this purpose with a through hole for the insertion from above of a fastener, such as a screw 32 or similar, whose thread engages with the filler piece 18. In this condition the parts 26, 28 of the cassette have a clearance between their horizontal faces so as to exert, by means of the torque on the screw 32, a clamping force on the knife 30 which will reliably hold fast said knife between the parts of the cassette. In order to prevent particles separated from the chips from penetrating into the interfaces between the knife 30 and the bottom part 28 of the cassette, between the said bottom part 28 and the filler piece 18, and between the filler piece 18 and the chopper disk 10, all these components are so disposed that the width of the opening 12 increases stepwise downwards at each interface, as illustrated at 34, 36 and 38 in FIG. 1. It is also advisable for the opening 12 to flare conically downwards in order to prevent clogging.

Figure 2:
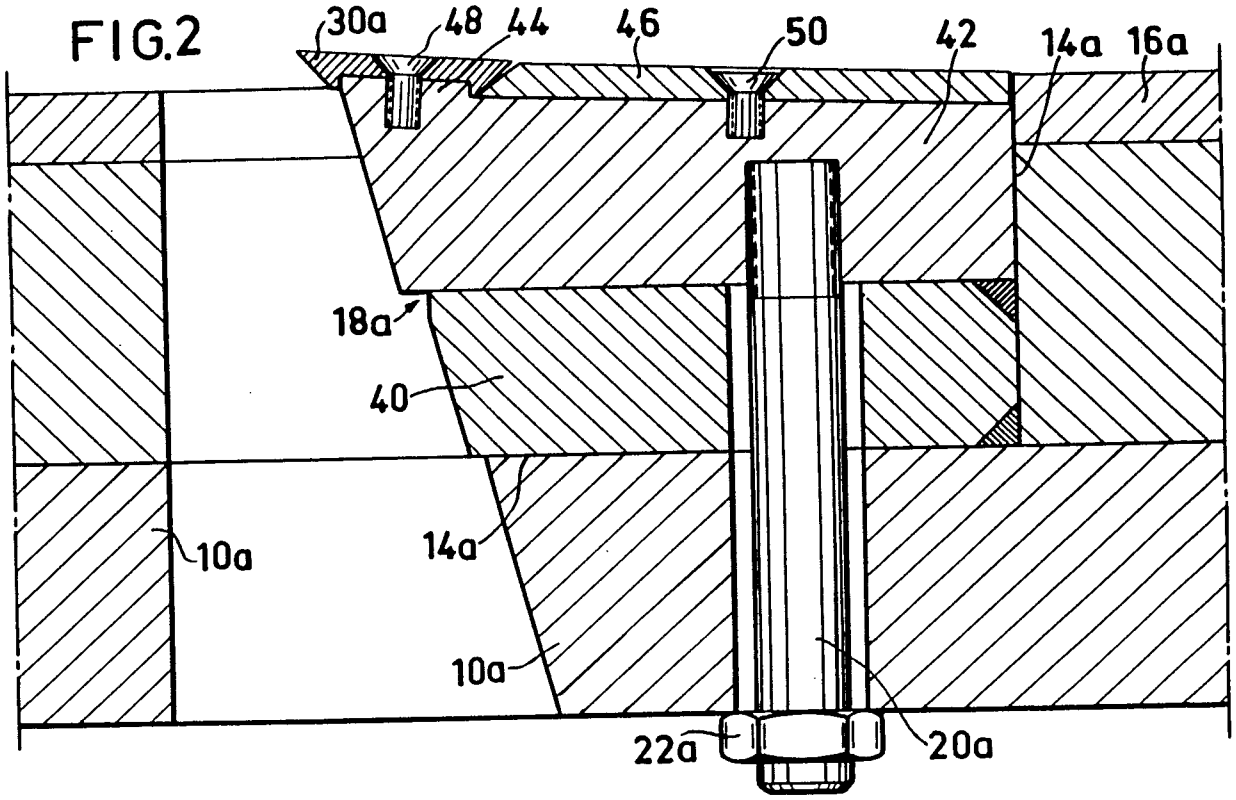
FIG. 2 shows a similar section of a modified embodiment.

In the embodiment illustrated in FIG. 2 the components common to both figures are denoted by the same numbers as in FIG. 1 with the suffix "a". The chopper disk **10*a* is provided with a recess 14*a* having perpendicular walls. The filler piece 18*a* consists of a lower section 40 which is welded to the rear of the recess 14*a* in the chopper disk 10*a* and an upper section 42 fastened by means of a bolt 20*a* which passes through the chopper disk to the underside thereof, where the bolt is tightened by means of a nut 22*a*. The upper section 42 of the filler piece 18*a* serves as a knife holder and is provided with a projection 44 which engages with a matching recess in the knife 30*a*. After the knife, in the direction of rotation, the knife holder 42 is provided with a separate wear plate 46. The knife 30*a* and the wear plate 46 are fastened to the knife holder 42 from the upper side of the chopper disk by means of screws 48, 50**, so that these parts are readily replaced.

We claim:

1. A device for use in choppers with a rotating chopper disk that has a top side and a bottom side, having a knife attached to a knife holder disposed radially on the chopper disk, characterized in that the knife holder includes a filler piece fitting into a recess in the chopper disk, and a knife holder cassette for the knife, the knife holder cassette having a top part and a bottom part, the top and bottom parts being shaped to clamp the knife therebetween, the top and bottom parts being selectively separable to permit knife replacement, the filler piece incorporating a mounting for the knife holder cassette, the cassette being attached to the filler piece by means of a first fastener inserted from the top side of the chopper disk, the first fastener abutting the top part of the knife holder cassette and clamping the knife in place, the filler piece being held fast in the recess in the chopper disk by means of a second fastener, the first fastener being threaded only into the filler piece and not extending through the filler piece into the chopper disk to clamp the knife in place and secure the cassette to the filler piece.

2. The device according to claim 1, characterized in that the first fastener is a screw whose head is countersunk into a top surface of the knife holder cassette.

3. The device according to claim 1, characterized in that the second fastener is a bolt, said bolt passing through to the bottom side of the chopper disk, a nut being threaded into the bolt from the bottom side of the chopper disk.

4. The device according to claim 1, wherein the filler piece forms one edge of an opening for chip flow through the chopper disk, the opening having a diameter, and wherein the interface between the bottom part and the filler piece and the interface between the filler piece and the chopper disk are rebated in such a manner that the width of the opening increases in an axial direction away from the knife.

5. A device for use in choppers with a rotating chopper disk that has a top side and a bottom side, having a knife attached to a knife holder disposed radially on the chopper disk, characterized in that the knife holder includes a filler piece, a first fastener, and a second fastener, the filler piece fitting into a recess in the chopper disk, the filler piece being held fast in the recess in the chopper disk by the first fastener passing through from the bottom side of the chopper disk into the filler piece the filler piece incorporating a mounting for a knife shaped to fit the mounting, the knife being attached to the filler piece by means of the second fastener inserted from the top side of the chopper disk, the second fastener abutting the knife and clamping the knife in place, the second fastener passing completely through the knife, the second fastener being threaded only into the filler piece and not extending through the filler piece into the chopper disk to clamp the knife in place and secure the knife to the filler piece.

6. The device according to claim 5, characterized in that the mounting has a projection which fits a matching recess in the knife.

7. The device according to claim 8, characterized by a wear plate butting on the knife, the wear plate being fastened to the filler piece by means of screws whose heads are countersunk into the wear plate.

8. The device according to claim 5, characterized in that the second fastener is a screw whose head is countersunk into a top surface of the knife.

9. The device according to claim 5, wherein the filler piece forms one edge of an opening for chip flow through the chopper disk, the opening having a diameter, and wherein the interface between the filler piece and the chopper disk is rebated in such a manner that the width of the opening increases in an axial direction away from the knife.

* * * * *

UNITED STATES PATENT AND TRADEMARK OFFICE

CERTIFICATE OF CORRECTION

PATENT NO. : 4,694,995

DATED : September 22, 1987

INVENTOR(S) : Erne L. Holmberg and Torbjorn C. Andersson

It is certified that error appears in the above-identified patent and that said Letters Patent is hereby corrected as shown below:

Cover Sheet, Related U.S. Application Data Section, after "abandoned" insert --which is a Continuation of Ser. No. 486,407, April 19, 1983, abandoned--.

Column 1, line 2, after "abandoned" insert --, which application is a continuation of application Ser. No. 486,407, filed April 19, 1983, now abandoned--.

Signed and Sealed this

Sixteenth Day of February, 1988

*Attest:*

*Attesting Officer*

DONALD J. QUIGG

*Commissioner of Patents and Trademarks*

US004694995B1

REEXAMINATION CERTIFICATE (4199th)

United States Patent [19] [11] B1 4,694,995

Holmberg et al. [45] Certificate Issued Nov. 14, 2000

[54] DEVICE IN CONNECTION WITH CHOPPERS

[75] Inventors: Erne L. Holmberg, Hudiksvall; Torbjorn C. Andersson, Forsa, both of Sweden

[73] Assignee: Iggesund Turnknife Systems, Inc., Tampa, Fla.

Reexamination Request:
No. 90/005,012, Jun. 8, 1998

Reexamination Certificate for:

| | |
|---|---|
| Patent No.: | **4,694,995** |
| Issued: | **Sep. 22, 1987** |
| Appl. No.: | **06/937,434** |
| Filed: | **Dec. 3, 1986** |

Certificate of Correction issued Feb. 16, 1988.

Related U.S. Application Data

[63] Continuation of application No. 06/717,584, Mar. 29, 1985, abandoned, which is a continuation of application No. 06/486,407, Apr. 19, 1983, abandoned.

[30] Foreign Application Priority Data

Apr. 21, 1982 [SE] Sweden ..... 8202509

[51] Int. Cl.[7] ..... B02C 18/18

[52] U.S. Cl. ..... 241/92; 241/298

[58] Field of Search ..... 241/92, 298; 29/525.11, 29/525.12

[56] References Cited

U.S. PATENT DOCUMENTS

| | | | |
|---|---|---|---|
| 1,906,486 | 5/1933 | Payzer | 241/92 |
| 2,174,593 | 10/1939 | Pelot et al. | 241/92 |
| 2,566,938 | 9/1951 | Johnson | 241/92 |
| 2,712,904 | 7/1955 | Durkee | 241/92 |
| 3,144,995 | 8/1964 | Fontaine | 241/92 X |
| 3,981,337 | 9/1976 | Sundstrom . | |
| 4,155,384 | 5/1979 | Svensson . | |
| 4,271,882 | 6/1981 | Valo . | |
| 4,298,044 | 11/1981 | Hansel et al. . | |
| 4,346,744 | 8/1982 | Beer et al. . | |

OTHER PUBLICATIONS

"New 2nd Generation Disposable Chipper Knife: Delivers Uniformity; Reduces Downtime and Cost", *American Logger and Lumberman*, May 1983.

Douglas C. Beer, *Theory and Practice of Flake Production for Increased Recovery and Profit*, May 1980.

*Primary Examiner*—Mark Rosenbaum

[57] ABSTRACT

A device for use in choppers with a rotating chopper disk (10, 10a) having one or more knives attached to knife holders disposed radially on the chopper disk, which knife holders consist of a filler piece (18, 18a) fitting into a recess (14, 14a) in the chopper disk (10, 10a). The filler piece incorporates a mounting either for a knife (30a) shaped to fit the mounting, or for a knife holder cassette (26, 28) for the knife (30). The knife (30a) or the cassette (26, 28) are attached by means of fasteners (32, 48), such as screws or bolts, inserted from the top side of the chopper disk.

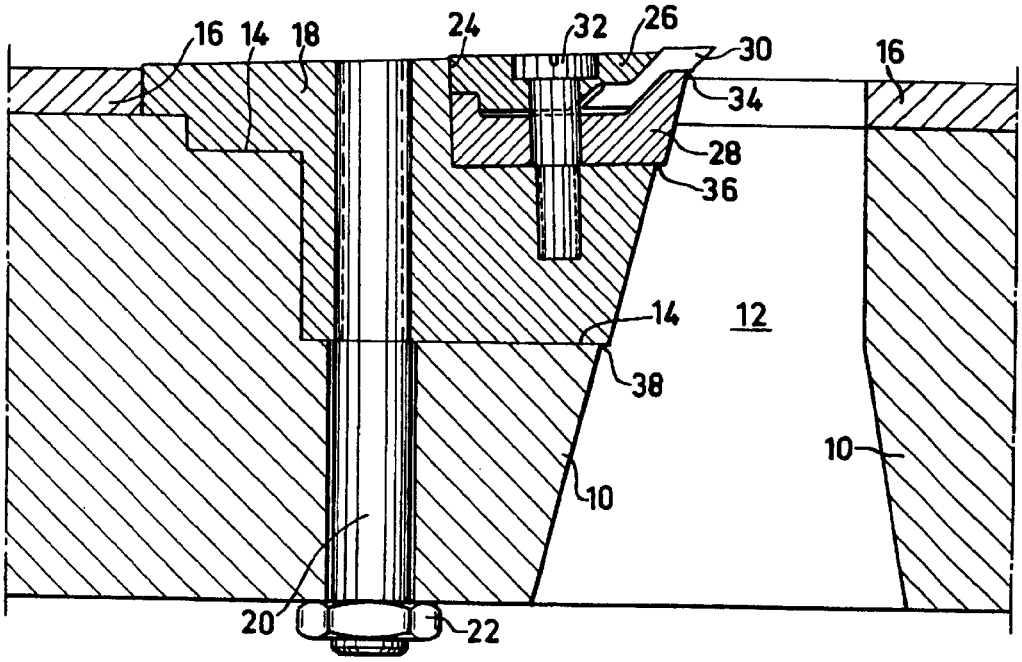

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 5 and 9 are determined to be patentable as amended.

Claims 2, 3 and 6–8, dependent on an amended claim, are determined to be patentable.

New claims 10 and 11 are added and determined to be patentable.

1. A device for use in choppers [with] *having* a rotating chopper disk that has a top side [and], a bottom side, [having a knife attached to] *and a plurality of radially extending openings therein which define passageways through the disk from the top side to the bottom side, said disk including a plurality of recesses formed therein respectively located adjacent each of said openings, said recesses including a plurality of surfaces formed in the disk arranged such that each said recess opens toward its associated passageway and the top of the disk, said device including* a knife holder disposed radially *in one of said recesses* on the chopper disk *and a knife mounted on the holder*, characterized in that [the] *said* knife holder includes a filler piece [fitting] *fitted* into [a recess] *one of said plurality of recesses* in the chopper disk *with surfaces of said filler piece generally complementary to the surfaces of the one of said plurality of recesses*, and a knife holder cassette for the knife, the knife holder cassette having a top part and a bottom part, the top and bottom parts being shaped to clamp the knife therebetween, the top and bottom parts being selectively separable to permit knife replacement, [the] *said* filler piece [incorporating a] *having a second recess formed therein opening towards the passageway associated with said one of said plurality of recesses and the top of the disk and including a plurality of* mounting *surfaces* for *supporting* the knife holder cassette, [the] *said* cassette being attached to the filler piece by [means of] a first fastener inserted from the top side of the chopper disk, [the] *said* first fastener *having means for* abutting the top part of the knife holder cassette and clamping the knife in place *against the bottom part of the knife holder cassette, and a second fastener inserted from the bottom side of the disk into* the filler piece [being held], *but not into the top or bottom part of the knife holder cassette, for holding the filler piece* fast in the [recess] *one of said plurality of recesses* in the chopper disk [by means of a second fastener], [the] *said* first fastener being threaded only into the filler piece and not extending through the filler piece into the chopper disk to clamp the knife in place and secure the cassette to the filler piece.

4. The device according to claim 1, wherein the filler piece forms one edge of [an] *the* opening [for chip flow through] *in* the chopper disk *adjacent the recess in the disk in which the filler piece is fitted*, the opening having a diameter, and wherein the interface between the bottom part and the filler piece and the interface between the filler piece and the chopper disk are rebated in such a manner that the width of the opening increases in an axial direction away from the knife.

5. A device for use in choppers [with] *having* a rotating chopper disk that has a top side, [and] a bottom side, [having a knife attached to] *and a plurality of radially extending openings therein which define passageways through the disk from the top side to the bottom side, said disk including a plurality of recesses formed therein respectively located adjacent each of said openings, said recesses each including a plurality of surfaces formed in the disk arranged such that said recesses open towards their associated passageways and the top of the disk, and said device including* a knife [holder] *support* disposed radially *in one of said recesses* on the chopper disk *and a knife mounted on the support*, characterized in that [the] *said* knife [holder] *support* includes a filler piece *fitted into one of said plurality of recesses in the chopper disk with surfaces of said filler piece generally complementary to the surfaces of the one of said plurality of recesses*, a first fastener, and a second fastener, [the filler piece fitting into a recess in the chopper disk,] *said first fastener passing from the bottom side of the disk through the disk and only into said filler piece thereby to secure* the filler piece [being held] fast in the recess [in the chopper disk by the first fastener passing through] *only* from the bottom side of the chopper disk [into the filler piece the], *said* filler piece [incorporating] *having* a mounting for a knife, *said mounting including a plurality of angularly related surface portions, said knife having a mounting surface generally complementary to said angularly related surfaces portions of the mounting to sit on and being* shaped to fit the mounting, *said second fastener passing from the top side of* the *disk through said* knife [being attached] *only into said filler piece to attach the knife* to the filler piece [by means of the second fastener inserted] *only* from the top side of the chopper disk, the second fastener *having a head* abutting the knife [and clamping the knife in place, the second fastener] *and a shank* passing completely through *an aperture in* the knife *to clamp the knife in place on said plurality of angularly related surfaces*, the second fastener being threaded only into the filler piece and not extending through the filler piece into the chopper disk to clamp the knife in place and secure the knife to the filler piece *whereby the knife can be removed and replaced only from the top side of the disk without releasing the filler piece from the disk.*

9. The device according to claim 5, wherein the filler piece forms one edge of [an] *the* opening [for chip flow through] *in* the chopper disk *adjacent the recess in the disk in which the knife support is fitted*, the opening having a diameter, and wherein the interface between the filler piece and the chopper disk is rebated in such a manner that the width of the opening increases in an axial direction away from the knife.

*10. A chopper comprising:*

*a disk having a top side, a bottom side, and a plurality of first recesses extending from the top side towards the bottom side:*

*a knife holder disposed radially on the disk including:*

*(i) a filler piece having a second recess, the filler piece being fitted within one of said plurality of first recesses; and*

*(ii) a knife holder cassette having a top part and a bottom part, the knife holder cassette being received within said second recess;*

*a knife positioned between said top part and said bottom part:*

*a first fastener having a head, the first fastener passing through said top part and threaded into but not extending completely through said filler piece into said disk with the head abutting against said top part, such that said knife is clamped between said top part and said bottom part and said knife holder cassette is attached to said filler piece in said second recess: and*

*a second fastener abutting against said bottom side of said disk and passing completely through said disk and into said filler piece, but not into said top part nor said bottom part, such that such filler piece is attached to said disk in said one of said plurality of first recesses.*

*11. A chopper comprising:*

*a rotatable chopper disk having a top side, a bottom side, and a plurality of radially extending openings which define passageways through the disk from the top to the bottom side thereof, said disk including a plurality of first recesses formed therein respectively located adjacent each of said openings, said recesses, including at least a first surface below and generally parallel to said top side and a second surface extending from said first surface to said top side whereby the recesses in said disk are open towards said passageways and above said first surface,*

*a plurality of knife holders disposed radially on the chopper disk and respectively associated with each of said recesses including:*

(*i*) *a filler piece having a second recess formed therein opening towards its adjacent passageway and said top side of the disk, the filler piece being fitted within its associated first recess and having surface portions generally complementary to the first and second surface portions of its associated first recess: and*

(*ii*) *a knife holder cassette having a top part and a bottom part, the knife holder cassette being received within said second recess;*

*a knife positioned between said top part and said bottom part;*

*a first fastener having a head, the first fastener passing though said top part and threaded into but not extending completely through said filler piece into said disk with the head abutting against said top part, such that said knife is clamped between said top part and said bottom part and said knife holder cassette is attached to said filler piece in said second recess; and*

*a second fastener having a head abutting against said bottom side of said disk and a shank passing completely through said disk and into said filler piece, but not into said top part nor said bottom part, such that said filler piece is attached to said disk in its associated first recess.*

* * * * *